United States Patent [19]

Stephenson et al.

[11] 3,934,654

[45] Jan. 27, 1976

[54] EARTHWORKING BLADE DEVICE

[75] Inventors: Earle W. Stephenson, Latrobe; Leonard E. Toews, Greensburg, both of Pa.

[73] Assignee: Kennametal Inc., Latrobe, Pa.

[22] Filed: Sept. 6, 1974

[21] Appl. No.: 503,957

[52] U.S. Cl. ..... 172/719; 37/42 R; 37/141 R; 172/767; 172/747; 172/762

[51] Int. Cl.[2] ..... A01B 15/02; A01B 35/26; A01B 1/04; E02F 3/76

[58] Field of Search ..... 172/719, 767, 801, 747, 172/762, 713; 37/42 VL, 42 R, 41, 141 R; 299/79

[56] References Cited

UNITED STATES PATENTS

| | | | |
|---|---|---|---|
| 1,633,057 | 6/1927 | Wold | 172/767 |
| 1,778,512 | 10/1930 | Shunk | 172/767 |
| 3,239,275 | 3/1966 | Belugou | 299/79 |
| 3,529,677 | 9/1970 | Stephenson | 172/767 |

*Primary Examiner*—George J. Marlo
*Attorney, Agent, or Firm*—Melvin A. Crosby

[57] ABSTRACT

An earthworking blade arrangement, such as for a grader or snow plow blade or the like, in which a steel blade is mounted on the lower edge of a moldboard and extends downwardly therefrom while an axially segmented blade is secured to the lower edge of the steel blade and extends downwardly therefrom and is provided with hard wear resistant inserts mounted in the lower edge thereof and which forms the working edge of the blade assembly. Advantageously, the axially segmented member extends a substantial distance upwardly along the back of the steel blade and is bolted thereto.

13 Claims, 5 Drawing Figures

EARTHWORKING BLADE DEVICE

The present invention relates to earthworking blades and is particularly concerned with an improvement in grader blades and snow plow blades and the like.

Graders and snow plows are both well known devices and each thereof comprises a relatively long moldboard which extends generally laterally of the surface being worked and is moved over the surface in a direction generally perpendicular to the length of the moldboard. It is conventional to mount steel blade members on the lower edges of such moldboards with the steel blade members extending downwardly below the lower edge of the moldboard and having a lower edge forming the working surface of the device.

It is also known to slot the lower edges of the steel blade members and to mount therein in side by side relation blocks of hard wear resistant material such as cemented hard metal carbide, particularly, tungsten carbide.

The conventional arrangements of providing a moldboard with blade members, and including blade members having carbide blocks mounted therein, is rather wasteful of steel because a steel blade member will wear away quite rapidly and a blade member provided with carbide blocks is generally discarded when the blocks are worn away.

With the foregoing in mind, an object of the present invention is the provision of an improved arrangement for providing the moldboard of an earthworking device such as a grader or scraper or snow plow with a wear resistant working edge region.

Another object of the present invention is the provision of a working edge for a device of the nature referred to which is economical in respect of the use of steel.

Still another object is the provision of an arrangement for providing a working edge for a device of the nature referred to in which improved working conditions are obtained by the particular configuration of the element forming the working edge of the moldboard.

A further object is the provision of a working edge for the moldboard of a device of the nature referred to in which the working edge is segmented axially into sections substantially smaller than the total length of the moldboard.

BRIEF SUMMARY OF THE INVENTION:

According to the present invention, a moldboard for a grader or scraper or snow plow is provided and connected to the lower edge thereof and extending downwardly therefrom is a steel blade. Extending along the steel blade, near the bottom, and dependent from the lower edge of the steel blade, is a working edge element which is axially segmented so that each section of the working edge member is substantially shorter than the steel blade to which it is attached.

In the lowermost edge of each edge member, there is provided an axial slot and mounted in side by side relation in each slot is a plurality of hard wear resistant blocks formed, for example, from cemented hard metal carbide, such as tungsten carbide cemented by cobalt. Bolts secure the steel blade to the moldboard and further bolts extending through the steel blade and the edge members secure the steel blade and the edge members together.

The edge member is preferably an extrusion or forging and is of such a configuration that, taken together with the carbide blocks, provides for long wearing capabilities of the edge members. In particular, the lower ends of the carbide blocks are so configured as to deflect material moved by the blade forwardly and away from the steel of the edge member thereby inhibiting the rapid wear, or washing out of the steel of the edge member in front of the carbide blocks.

Furthermore, the blocks are so configured that in a preferred position of the blade which carries the edge members, a substantial area of each block faces downwardly and is substantially parallel to the surface being worked.

The edge members are advantageously mounted on the rearward side of the steel blades and include a forwardly offset region at the bottom extending forwardly beneath the lower edge of the steel blade. However, the edge members could be mounted on the forward side of the steel blade, if desired.

The exact nature of the present invention will become more apparent upon reference to the following detailed specification taken in connection with the accompanying drawings in which.

Figure 1:
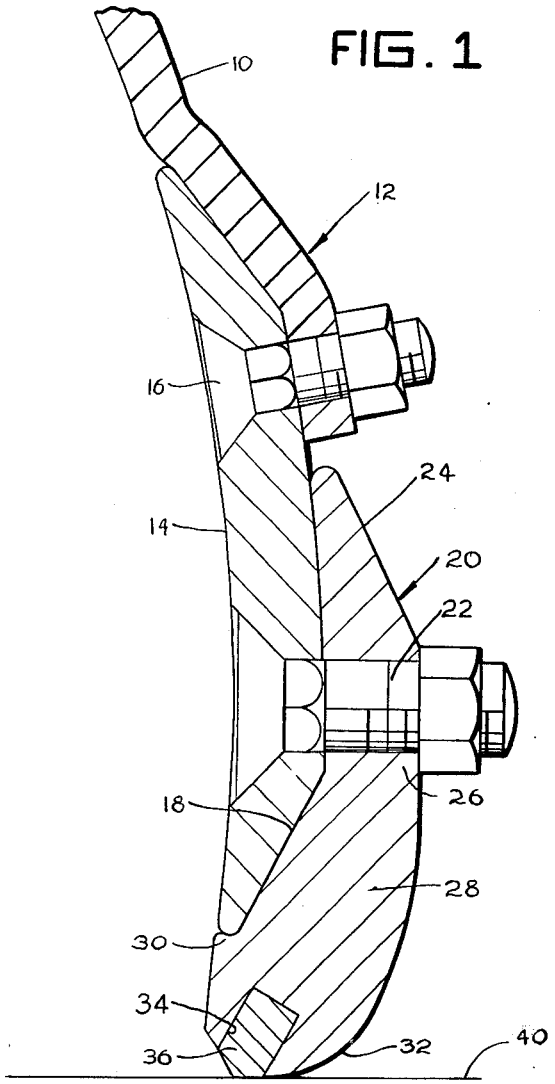
FIG. 1 is a vertical sectional view showing the lower edge of a moldboard with a steel blade secured to the bottom edge thereof and with edge members according to the present invention secured to the lower portion of the steel blade extending downwardly beneath the lower edge of the steel blade.

DETAILED DESCRIPTION OF THE INVENTION:

Referring to the drawings somewhat more in detail, in FIG. 1, 10 indicates the lower portion of a substantially conventional moldboard such as might be employed on a grader or scraper or a snow plow. The extreme lower edge of the moldboard is offset to the rear as indicated at 12 and fits over the rear of the top region of a steel blade 14 and which is substantially rigidly secured to moldboard 10 as by plow bolts 16 extending through the steel blade and the lower offset region 12 of the moldboard.

According to the present invention, the lower edge of steel blade 14 tapers inwardly toward the bottom by virtue of a flat region 18 formed on the rear thereof and which may be, for example, about 1¼ inches in length.

The steel blade 14 is generally concave toward the front and may be formed to a radius of about 10½ to 11 inches, for example.

Mounted on the blade member 14 so as to project downwardly from the lower edge thereof are blade edge members according to the present invention and generally indicated at 20.

Figure 2:
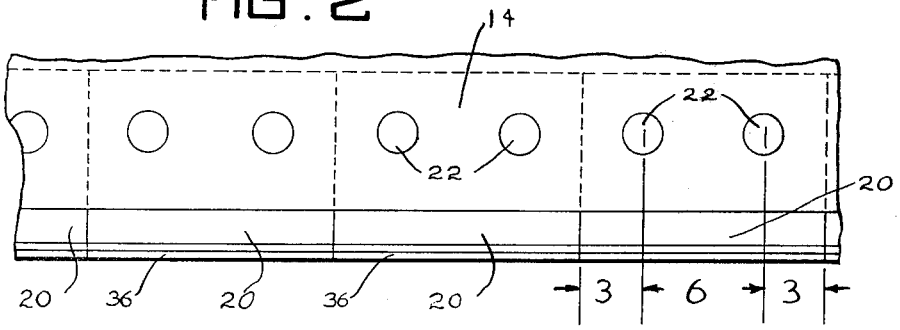
FIG. 2 is a schematic front elevational view showing the manner in which the members forming the working edge of the steel blade are provided in the form of relatively short sections and are placed end to end on the steel blade.

As will be seen in FIG. 2, the edge members 20 are substantially shorter than steel blade 14. The edge members, for example, may be 12 inches long whereas blade 14 may be several feet in length.

The steel blade 14 is provided with holes through which plow bolts 22 extend to connect the edge members to the steel blade. As will be seen in FIG. 2, these bolts may be 6 inches apart so that each edge member has two holes formed therein each 3 inches inwardly from the adjacent edge and 6 inches apart.

Each edge member 20 comprises an inwardly tapering upper portion 24 and an intermediate region 26 through which bolts 22 pass. Below intermediate region 26 each edge member tapers outwardly along a region 28 so as to fit against the inclined rearward face 18 of blade 14 near the lower edge thereof. The forward side of the region 28 includes a forwardly projecting portion 30 immediately beneath the lower edge of the blade 14 and advantageously projecting slightly forwardly therefrom to provide for the flow of earth upwardly along the face of blade 14 without an accumulation at the lower edge of the blade.

At the extreme lower edge of each blade member 20, the edge member is formed to a somewhat rounded configuration as indicated at 32 and each edge member also comprises a longitudinal slot 34 in which hard wear resistant inserts 36 are mounted in side by side relation.

Figure 5:
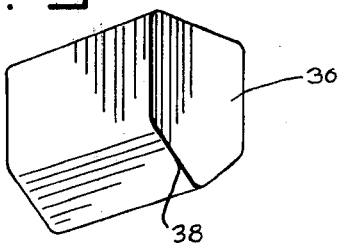
FIG. 5 is a perspective view showing a typical wear resistant insert.

FIG. 5 shows a typical insert 36. Such an insert might be an inch long and can vary in front to back thickness and also in heighth. The lower edge 38 of each insert is "V" shaped in cross section and, as will be seen in FIG. 1, the rearward side of the "V" shape is substantially parallel to the surface 40 being worked and substantially tangent to the rounded portion 32.

The forward side of the "V" shaped configuration on the lower edge of each insert inclines upwardly and forwardly and merges with the forward face of the respective edge member. Due to the disposition of the wear resistant inserts and the presenting of one face of the "V" shaped outer edge downwardly and the other face forwardly at a forwardly inclined angle, the edge members wear slowly when engaging an abrasive surface such as a roadway or a berm while earth, sand, stones and rocks and the like dislodged by the blade tend to be deflected in the forward direction and thereby reduce the abrasive effect of the material on the blade.

In cases where the hard wear resistant inserts have a steeply rising front face, the material moving upwardly therealong tends to abrade the steel in front of and above the wear resistant inserts to a considerable degree and when the supporting steel around an insert is diminished, even though the diminishing of the steel support is only in front of the insert, the possibility exists that the insert can become dislodged and lost from the steel support while there is a great deal of life left in the insert.

Such inserts are advantageously formed of cemented hard metal carbide material, such as tungsten carbide cemented with cobalt or the like and are extremely hard and wear resistant but do require adequate support by steel and must be fixedly connected to the steel, as by brazing. With the arrangement of the present invention, the steel support remains in surrounding relation to the inserts, and with the inserts brazed in position, long life of the insects is insured.

Figure 3:
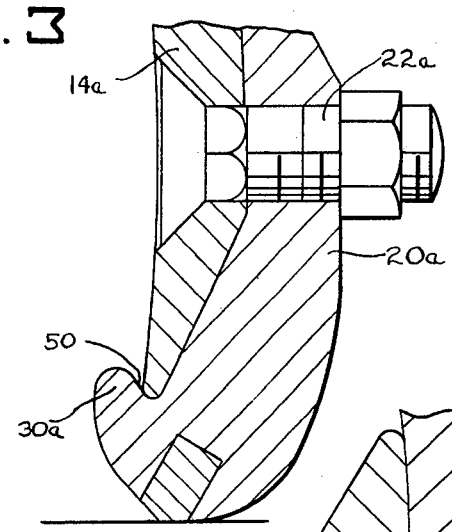
FIG. 3 shows a modification.

FIG. 3 shows a modified arrangement in which the forwardly protruding portion 30*a* of the edge member 20*a* is formed to a hook formation 50 which engages the lowermost edge of the steel blade 14*a*. The hook region 50 can be formed on the steel portion of the edge member as by extrusion or forging and prevents the bolt 22*a* from being unduly stressed as would be the case if the edge member were to strike an obstruction. In all other respects, the modification of FIG. 3 conforms to that of FIGS. 1 and 2.

Figure 4:
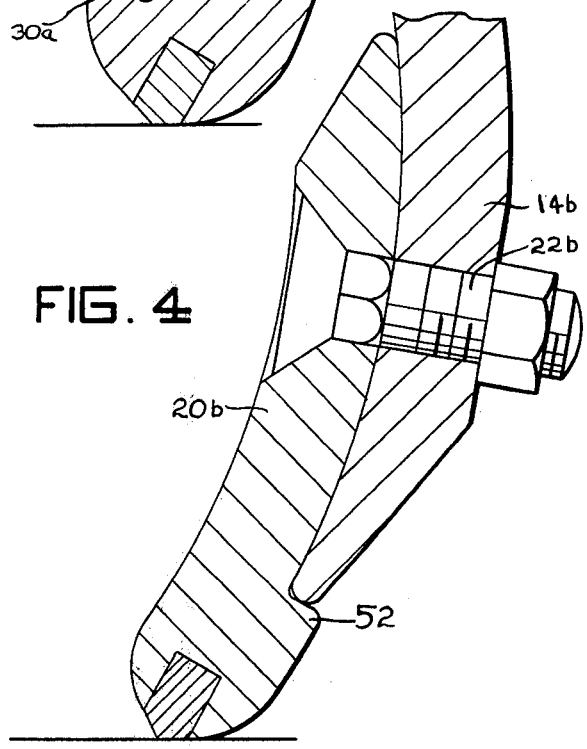
FIG. 4 shows a further modification.

FIG. 4 shows an arrangement wherein an edge member 20*b* according to the present invention is mounted on the forward side of a blade 14*b* and secured thereto by plow bolts 22*b*. In the FIG. 4 modification, the general configuration of the edge member 20*b* is about the same as it is in FIG. 1 except that the edge member is secured to the forward side of the blade and has a rearwardly protruding portion 52 disposed at the bottom edge of steel blade 14*b*.

The configuration of the lower portion of the edge member is substantially the same as that described in connection with FIG. 1. In the FIG. 4 arrangement, the edge member 20*b* protects the lower region of the steel blade 14*b* and substantially all abrasive wear will take place on the edge member itself.

Furthermore, a somewhat longer lever arm is presented for the load placed on bolt 22*b* than is the case with the FIG. 1 arrangement and the bolt is thereby less subject to breakage on account of shock loading that may be imposed on the edge member.

In each of the illustrated modifications, the body of the edge member is advantageously formed of a steel having greater resistance to abrasion than the steel of the blade. Tool steel, for example, can be used for the body of the edge member and the body will exhibit substantially greater hardness than the steel of the blade and this will retard wear of the body in front of the carbide inserts and provide for longer life of the edge members.

It is to be further understood that the blade member 14 referred to in the illustrations is preferably a steel material when used with earthworking devices but may be made of any material other than steel.

Modifications may be made within the scope of the appended claims.

What is claimed is:

1. An edge member adapted for mounting on the lower part of a blade for a scraping device such as a grader or snow plow so as to extend downwardly from the blade and a fraction of the length of the blade; said edge member comprising a steel body configured to engage one of the forward and rearward sides of the lower part of the blade in face to face engagement therewith, said edge member having a region at the bottom which is thickened in the fore and aft direction, said thickened region being formed with a downwardly opening slot therein, blocks of hard wear resistant material fixedly seated in said slot in side by side relation and having a "V" shaped profile in cross section at the bottom with the apex of the "V" at the bottom, the rearward side of said profile extending substantially horizontally and the forward side of said profile extending upwardly and forwardly to deflect material taken by said edge member upwardly and forwardly.

2. An edge member according to claim 1 in which said thickened region is rounded on the rearward side and at the bottom is substantially tangent to the rearward side of said profile.

3. An edge member according to claim 1 in which said thickened region comprises an upwardly facing shoulder adapted to be disposed directly beneath the lower edge of said blade.

4. An edge member according to claim 1 in which said steel body is an extrusion.

5. An edge member according to claim 1 in which said steel body is a forging.

6. An edge member according to claim 1 in which said steel body is adapted to be mounted on the rearward side of said blade.

7. An edge member according to claim 1 in which said steel body is adapted to be mounted on the forward side of said blade.

8. An edge member according to claim 1 in which said steel body is adapted to be mounted on the rearward side of said blade, and said thickened region includes an upwardly opening hook formation on the forward side extending the full length of the steel body and adapted to receive the lower edge of said blade therein.

9. In combination; a steel blade adapted for mounting on the lower edge of the moldboard of a grader or snow plow so as to project downwardly therefrom, and a plurality of blade edge members mounted on the lower edge of said steel blade in side by side relation and extending downwardly from the lower edge of the steel blade, each edge member comprising a steel body configured to engage one of the forward and rearward sides of the lower part of the steel blade in face to face engagement therewith, said edge member having a region at the bottom which is thickened in the fore and aft direction, said thickened region being formed with a downwardly opening slot therein, blocks of hard wear resistant material fixedly seated in said slot in side by side relation and having a "V" shaped profile in cross section at the bottom with the apex of the "V" at the bottom, the rearward side of said profile extending substantially horizontally and the forward side of said profile extending upwardly and forwardly to deflect material taken by said edge member upwardly and forwardly.

10. The combination according to claim 9 in which said thickened region is rounded on the rearward side and at the bottom is substantially tangent to the rearward side of said profile.

11. The combination according to claim 9 in which said thickened region comprises an upwardly facing shoulder disposed directly beneath the lower edge of said steel blade.

12. The combination according to claim 9 in which said steel body is mounted on the rearward side of said steel blade, and said thickened region includes an upwardly opening hook formation on the forward side extending the full length of the steel body and adapted to receive the lower edge of said steel blade therein.

13. The combination according to claim 9 in which the steel of the steel body is more resistant to abrasion than the steel of said steel blade.

* * * * *